US009193210B2

(12) United States Patent
Hossain

(10) Patent No.: US 9,193,210 B2
(45) Date of Patent: Nov. 24, 2015

(54) FASTENER FOR SHEET OBJECTS

(75) Inventor: Shahnoor Hossain, Bushey Heath (GB)

(73) Assignee: BESPOKE LTD

( * ) Notice: Subject to any disclaimer, the term of this patent is extended or adjusted under 35 U.S.C. 154(b) by 0 days.

(21) Appl. No.: 14/358,947

(22) PCT Filed: Nov. 18, 2011

(86) PCT No.: PCT/GB2011/052261

§ 371 (c)(1),
(2), (4) Date: May 16, 2014

(87) PCT Pub. No.: WO2013/072649

PCT Pub. Date: May 23, 2013

(65) Prior Publication Data

US 2014/0359980 A1 Dec. 11, 2014

(51) Int. Cl.
*B42F 1/00* (2006.01)
*B42F 3/00* (2006.01)

(52) U.S. Cl.
CPC ... *B42F 1/00* (2013.01); *B42F 3/00* (2013.01); *Y10T 24/209* (2015.01)

(58) Field of Classification Search
CPC ..... B42F 3/00; B42F 13/12; B42F 1/00; Y10S 24/901; Y10T 24/209; Y10T 24/493; Y10T 24/4646; Y10T 24/4648; Y10T 24/4652; A44B 17/00
USPC ..... 24/67 P
See application file for complete search history.

(56) References Cited

U.S. PATENT DOCUMENTS

| | | | | |
|---|---|---|---|---|
| 1,390,342 | A * | 9/1921 | Delay | 40/301 |
| 1,596,955 | A | 8/1926 | Washburne | |
| 2,497,305 | A * | 2/1950 | Isaac et al. | 24/707.5 |
| 3,748,696 | A * | 7/1973 | Martin | 24/16 PB |
| 3,757,389 | A * | 9/1973 | Wiland | 24/708.6 |
| 4,241,477 | A * | 12/1980 | Freedom et al. | 24/67 R |
| 5,125,758 | A * | 6/1992 | DeWan | 402/25 |
| 6,978,522 | B2 * | 12/2005 | Liao | 24/459 |
| 2005/0063773 | A1 * | 3/2005 | Cameron | 403/373 |
| 2010/0263174 | A1 * | 10/2010 | Aller | 24/356 |

FOREIGN PATENT DOCUMENTS

EP 0085547 A1 8/1983

OTHER PUBLICATIONS

International Search Report for PCT/GB2011/052261, ISA/EP, mailed Aug. 14, 2012.

* cited by examiner

*Primary Examiner* — Robert J Sandy
*Assistant Examiner* — David Upchurch
(74) *Attorney, Agent, or Firm* — Harness, Dickey & Pierce, P.L.C.

(57) ABSTRACT

A fastener for sheet objects may include first and second portions which are positioned or are positionable in an adjacent spaced relationship with respect to each other so as to define a sheet object receiving region therebetween. Piercing means are provided which are movably mounted on the first portion. The piercing means may be adapted so as to pierce one or more sheet objects disposed within the sheet object receiving region when moved into an operative state in which the piercing means extends across the sheet object receiving region between the first and second portions. The fastener may further include retaining means for retaining the piercing means in the operative position when moved thereto.

20 Claims, 8 Drawing Sheets

FASTENER FOR SHEET OBJECTS

CROSS-REFERENCE TO RELATED APPLICATIONS

This application is a 371 U.S. National Stage of International Application No. PCT/GB2011/052261, filed Nov. 18, 2011. The disclosures of the above applications are incorporated herein by reference.

FIELD OF THE INVENTION

The present invention relates to a fastener for sheet objects or the like and, in particular to a fastener for sheets of paper.

BACKGROUND ART

Various different kinds of fasteners for fastening together sheet objects, such as sheets of paper, are known in the art. One class of such fasteners functions by applying a clamping force to the sheets to be fastened together, typically at one corner of a plurality of sheets. For example, the common paper clip and the binder clip or 'fold-back' clip function in this way. A disadvantage of the clamp type fastener is that it can become dislodged from the sheets by a simple sliding motion. Accordingly, movement of the fastened sheets relative to one another, such as that which may occur when a document is being read, may cause the fastener to slide off the sheets leaving them unfastened.

An alternative approach to the clamp type fastener is a fastener which secures a plurality of sheets together by piercing or puncturing the sheets to be fastened. For example, a metal staple is a well known fastener of this type. Staples are dispensed from a stapler which comprises an applicator portion disposed opposite a plate portion. Sheets to be fastened together are positioned between the applicator portion and the plate portion, and pressure exerted on the applicator portion against the stack of sheets causes a staple to be dispensed. The legs of the staple pierce the stack of sheets and are bent either toward or away from each other upon contact with the plate so as to secure the sheets together.

However, a drawback of the use of staples is that a separate applicator device, the stapler, is required to apply them. Additionally, the legs of the staple are not always reliably bent by the plate such that the sharp ends of the legs are embedded in the surface of the fastened papers. Accordingly, the ends of the legs may present an injury risk to a person handling the stapled papers. Furthermore, in the event that the papers need to be unfastened, a separate staple remover device is usually required to remove the staple, otherwise there is a further risk of injury to a user's hands.

Another type of fastener is the Treasury tag or India tag which generally comprises a piece of string with a bar of metal or plastic attached to each end. A stack of sheets may be fastened together by passing one of the bars through a hole formed in the stack of sheets using a hole punch. However, like stapling, fastening using this technique is inconvenient for the user because a separate device, in this case a hole punch, is required.

It is an aim of the present invention to provide a fastener for a sheet objects which substantially overcomes or mitigate at least some of the above-mentioned problems.

SUMMARY OF THE INVENTION

According to a first aspect of the present invention, there is provided a fastener for sheet objects comprising:

first and second portions which are positioned or are positionable in an adjacent spaced relationship with respect to each other so as to define a sheet object receiving region therebetween;

piercing means which are movably mounted on the first portion, the piercing means being adapted so as to pierce one or more sheet objects disposed within the sheet object receiving region when moved into an operative state in which the piercing means extends across the sheet object receiving region between the first and second portions; and retaining means for retaining the piercing means in the operative state when moved thereto.

Thus, the present invention advantageously provides a fastener for sheet objects, such as sheets of paper, which is capable of fastening the sheet objects together securely between the first and second portions by piercing the sheets and retaining the piercing means in the operative state. The provision of the retaining means obviates the need for a separate applicator device to apply the fastener, thereby providing a fastener which is convenient for a user.

The piercing means may be biased toward an initial state in which it does not extend across the sheet object receiving region so as to facilitate the insertion of sheet objects into the sheet object receiving region.

Conveniently, the piercing means is coupled to an operating member adapted for manipulation by a user. Preferably, the operating member comprises a button portion.

Advantageously, the fastener comprises biasing means for biasing the operating member toward an initial state in which the piercing means does not extend across the sheet object receiving region.

Conveniently, the piercing means comprises a pin member and, preferably, the pin member has a pointed end for piercing said one or more sheet objects.

The pin member may, conveniently, comprise an annular groove for engagement with the retaining means when the piercing means are in the operative state.

Conveniently, the pin member is arranged so as to project through a hole in the first portion when it is moved toward the operative state. Accordingly, the pin is shielded from the user's hand.

Preferably, the retaining means comprises a pin receiving member disposed on the second portion. More preferably, the pin receiving member comprises an aperture for receiving the pin member therein. Still more preferably, the pin receiving member comprises a disc and the aperture is disposed in the centre of the disc.

Advantageously, the pin receiving member may comprise at least one radial slot extending from the aperture toward the circumference of the disc. Accordingly, the at least radial slot allows the disc to flex so as to better accommodate the pin member.

The at least one radial slot may be linear. Alternatively, the at least one radial slot comprises a linear portion adjacent to the aperture and terminates in a portion having an increased width relative to the linear portion. Preferably, the pin receiving member comprises three radial slots spaced equiangularly around the aperture.

Conveniently, the pin receiving member is coupled to the second portion by means of press-fitting. Preferably, the pin receiving member is provided with at least one locking member for engagement with a corresponding opening provided in the second portion so as to couple the pin receiving member thereto.

Advantageously, the piercing means is received within a recess formed in the second portion when in the operative state. Accordingly, a user's hand is shield from the piercing means by the second portion when it is in the operative position.

Preferably, the sheet object receiving region is defined between respective substantially planar faces of the first and second portions. Thus, the substantially planar faces of the first and second portions facilitate the insertion of sheet objects therebetween.

Advantageously, the respective planar faces diverge so as to define an entry region of the sheet object receiving region in order to facilitate the insertion of one or more sheet objects thereinto.

The first and second portions may, conveniently, be coupled by a hinge in order to facilitate positioning of the first and second portions relative to sheet objects to be fastened. Preferably, the first and second portions are pivotable about the hinge between a closed position in which the sheet object receiving region is defined between respective substantially planar faces of the first and second portions and an open position in which the first and second portions are pivoted about the hinge away from the closed position.

Advantageously, the hinge is spring biased so as to urge the fastener toward the closed position or the open position in dependence on the angular position of the first and second portions about the hinge. Thus, fastening of sheet objects is made easier by the fastener being biased into the closed position. Alternatively, storage of the fastener may be made easier by it being biased into the open position.

Conveniently, the hinge is biased by a spring arm. Preferably, the hinge comprises at least one flexible linkage between the first portion and the second portion.

Preferably, the first and second portions are formed as a unitary body. Accordingly, the time required to assemble the fastener is minimised.

Conveniently, the body is made from a plastics material. Preferably, the body is made using an injection moulding process.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENTS

Figure 1:
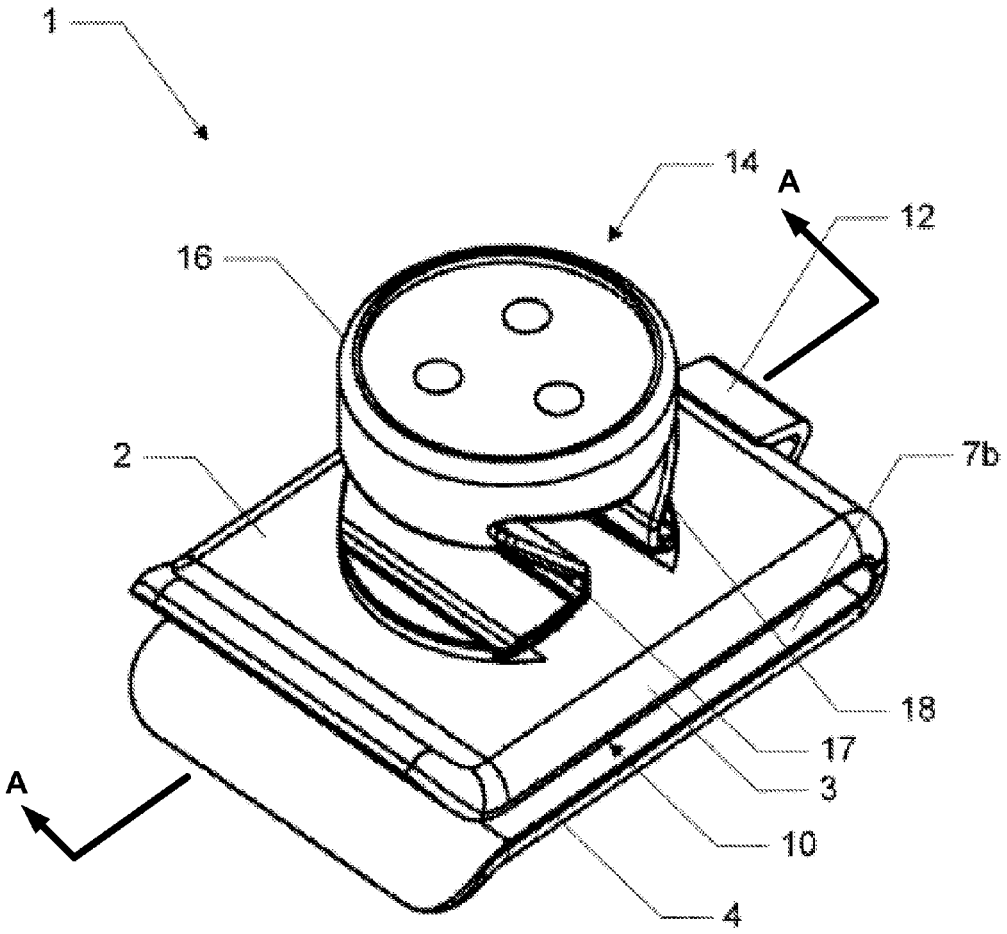
FIG. 1 is a perspective view of an embodiment of a fastener according to the present invention.
Figure 2:
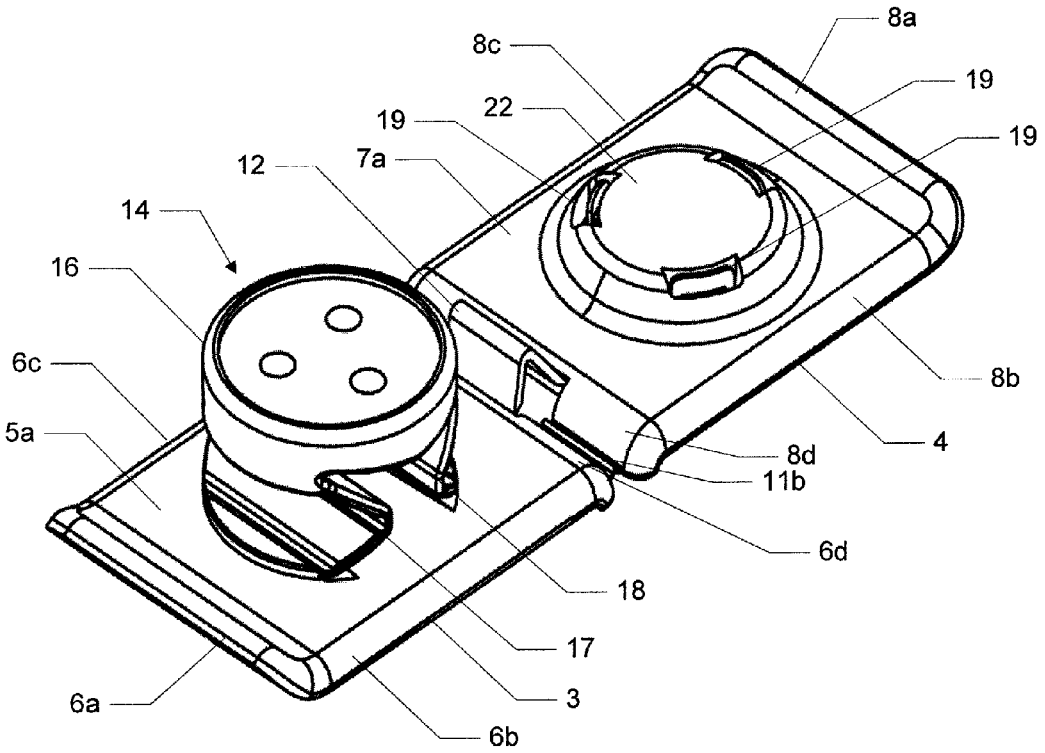
FIG. 2 is a perspective view of the fastener shown in FIG. 1 in an open position.
Figure 3A:
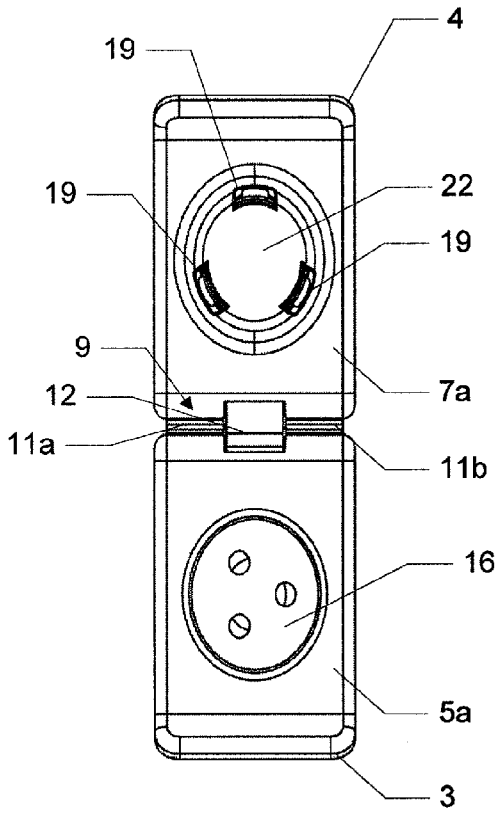
FIGS. 3*a* and 3*b* are plan views showing the fastener of FIG. 2 from above and below, respectively.

Referring to FIGS. 1, 2 and 3, the fastener 1 generally comprises a body 2 having first and second portions 3, 4. Each of the first and second portions 3, 4 are generally rectangular and planar in shape. The first portion 3 has first and second major faces 5*a*, 5*b* which are bounded by first, second, third and fourth edges 6*a*, 6*b*, 6*c*, 6*d*. Similarly, the second portion 4 has first and second major faces 7*a*, 7*b* which are bounded by first, second, third and fourth edges 8*a*, 8*b*, 8*c*, 8*d*.

The first and second portions 3, 4 are coupled by a hinge arrangement 9 along their respective fourth edges 6*d*, 8*d*. Accordingly, the first and second portions 3, 4 are movable between an open position shown in FIG. 2 and a closed position shown in FIG. 1. In the closed position the second face 5*b* of the first portion 3 is disposed adjacent to and facing the second face 7*b* of the second portion 4. The respective second faces 5*b*, 7*b* are spaced apart from each other when the fastener 1 is in the closed position so as to define a sheet object receiving region 10 therebetween.

The hinge arrangement 9 is spring biased so as to bias the fastener 1 toward either the open position or the closed position in dependence on the relative positions of the first and second portions 3, 4. In more detail, the hinge arrangement 9 acts so as to resist movement of the fastener 1 into the closed position when it is in the open position and, likewise, to resist movement of the fastener 1 into the open position when it is in the closed position. To this end, the hinge arrangement 9 comprises first and second flexible linkages 11*a*, 11*b* and a spring arm 12. The flexible linkages 11*a*, 11*b* are arranged on opposite sides of the spring arm 12. Each flexible linkage 11*a*, 11*b* couples the fourth edge 6*d* of the first portion 3 to the fourth edge 8*d* of the second portion 4, at respective positions adjacent to the second faces 5*b*, 7*b* of the first and second portions 3, 4.

The spring arm 12 is a generally V-shaped member, the ends of the 'V' being connected to the respective fourth edges 6*d*, 8*d* of the first and second portions 3, 4. The spring arm 12 is arranged such that movement of the fastener 1 from the open position toward the closed position causes the branches of the 'V' to diverge. The branches of the spring member 12 are biased toward each other and therefore act to resist movement of the fastener 1 away from the open position. This remains the case until the fastener 1 is at a neutral point approximately half way through the range of motion of the hinge arrangement 9, i.e. at the point where the first face 5*a* of the first portion 3 is approximately at right angles to the first face 7*a* of the second portion 4. Once the fastener 1 has been moved past the neutral point, the biasing force of the spring arm 12 acts to urge the first and second portions 3, 4 into the closed position.

The respective first edges 6*a*, 8*a* of the first and second portions 3, 4 are curved such that, when the fastener 1 is in the closed position, the respective second faces 5*b*, 7*b* of the first and second portions 3, 4 diverge. Accordingly, the respective first edges 6*a*, 8*a* define and entry region of the sheet object receiving region 10 and serve to facilitate the insertion of sheet objects therein.

The first portion 3 includes an operating member 14 disposed on the first face 5*a* thereof. The operating member 14 comprises a button portion 16 supported by first and second legs 17, 18, which are disposed on opposite sides of the button portion 16. The operating member 14 also includes piercing means (not shown in FIGS. 1 to 3), which will be described in more detail later. Each leg 17, 18 includes a joint approximately half way therealong, which permit the legs 17, 18 to fold so as to allow movement of the button portion 16 toward the first face 5*a* of the first portion 3 in response to a pressing force exerted on the button portion 16 by a user. The legs 17, 18 are spring-biased so as to urge the button portion 16 away from the first face 5*a* of the first portion 3. A hole 20 is formed through the first portion 3 between the first and second faces 5*a*, 5*b* thereof. The button portion 16 of the operating member 14 is circular and the hole 20 is arranged so as to be co-axial with the button portion 16. As shown, for example, in FIG. 1, the button portion 16 has a raised lip disposed around its circumference. Conveniently, the lip defines a central circular area to which a sticker or the like, which may display a logo or advertisement, can be readily applied. Furthermore, a plurality of holes formed in the central area (which are a byproduct of the manufacturing process of the fastener) provide a convenient means for attaching an article thereto. For example, the article may be a radio-frequency identification (RFID) tag or the like.

The second portion 4 of the body 2 comprises a domed portion 22 disposed on the first face 7*a* thereof. The domed portion 22 defines a circular recess 24 in the second face 7*b* of the second portion 4. The recess 24 is arranged so as to be coaxial with the hole 20 in the first portion 3 when the fastener 1 is in the closed position. A plurality of openings 19 are provided in the first face 7*a* of the second portion 4 at spaced locations around the periphery of the domed portion 22. The fastener 1 further comprises retaining means 30 disposed adjacent to the recess 24 which will be described in more detail later.

Figure 4:
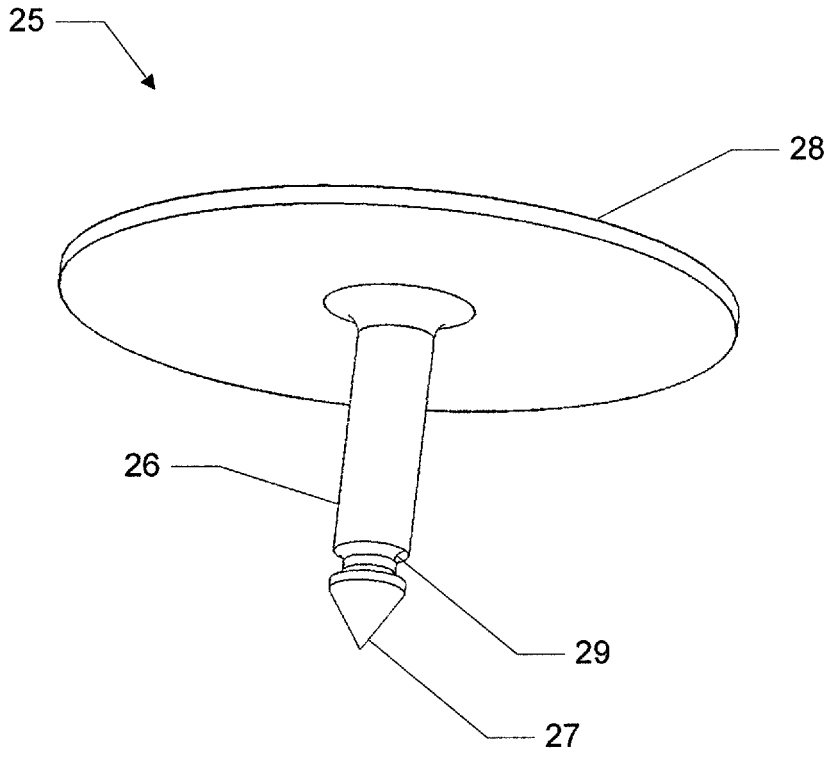
FIG. 4 is a perspective view showing piercing means of the fastener of FIG. 1.

Referring to FIG. 4, the piercing means 25 comprises a pin member 26 having a sharpened point 27 at first end thereof and a head portion 28 at a second end thereof. The head portion 28 is generally disc-shaped and is co-axial with the body of the pin member 26. An annular groove 29 is disposed on the pin member 26 adjacent to the point 27.

Figure 5:
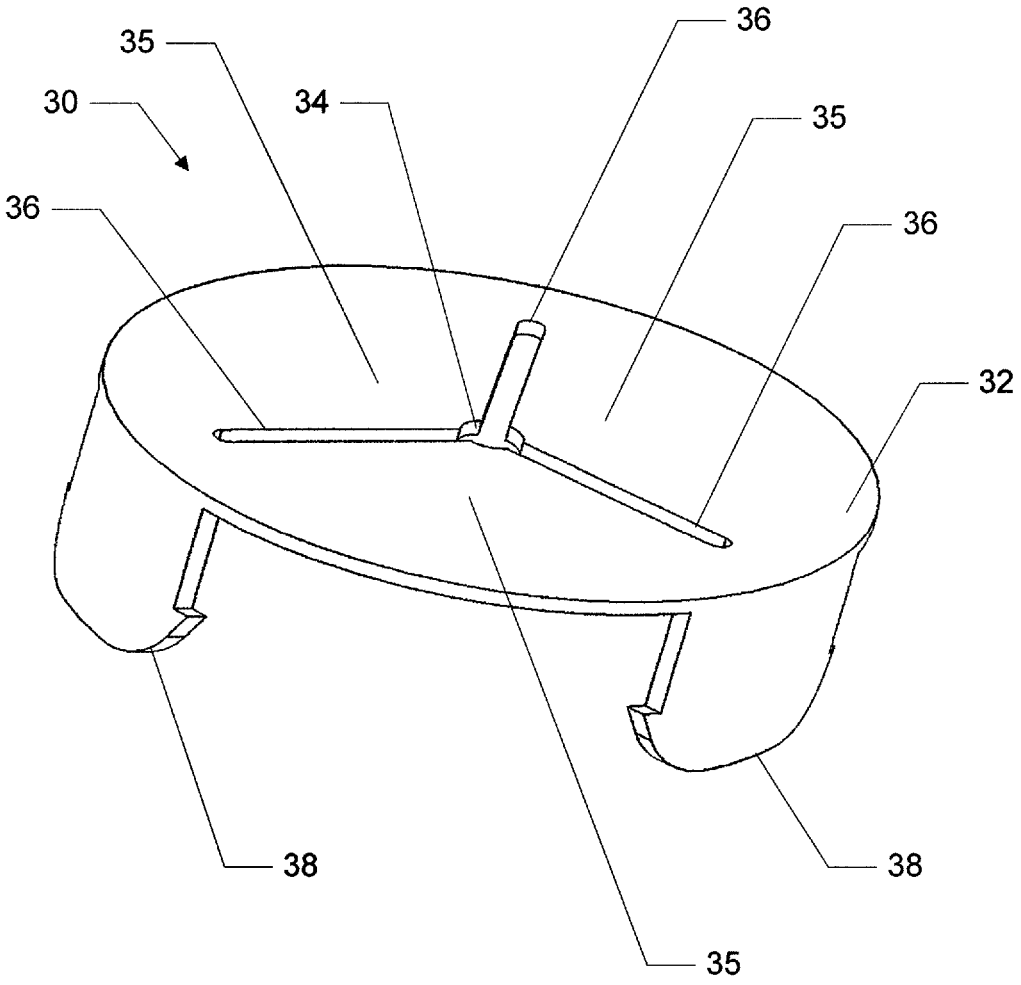
FIG. 5 is a perspective view showing retaining means of the fastener of FIG. 1.

Referring to FIG. 5, the retaining means 30 comprises a pin receiving member 32 in the form of a disc which is provided with an axial aperture 34. A plurality of radial slots 36 extend from the aperture 34 toward the circumference of the disc 32. The radial slots 36 are provided so as to enable the portions 35 of the disc 32 between the slots 36 to flex in a direction perpendicular to the plane of the disc 32 in order to receive and retain the pin member 26 of the piercing means 25 as will be described in more detail later. A plurality of locking members 38 are disposed at locations around circumference of the disc 32. Each locking member 38 projects substantially at right angles to the plane of the disc 32 and serves to secure the retaining means 30 within the body 2 of the fastener 1.

Figure 6:
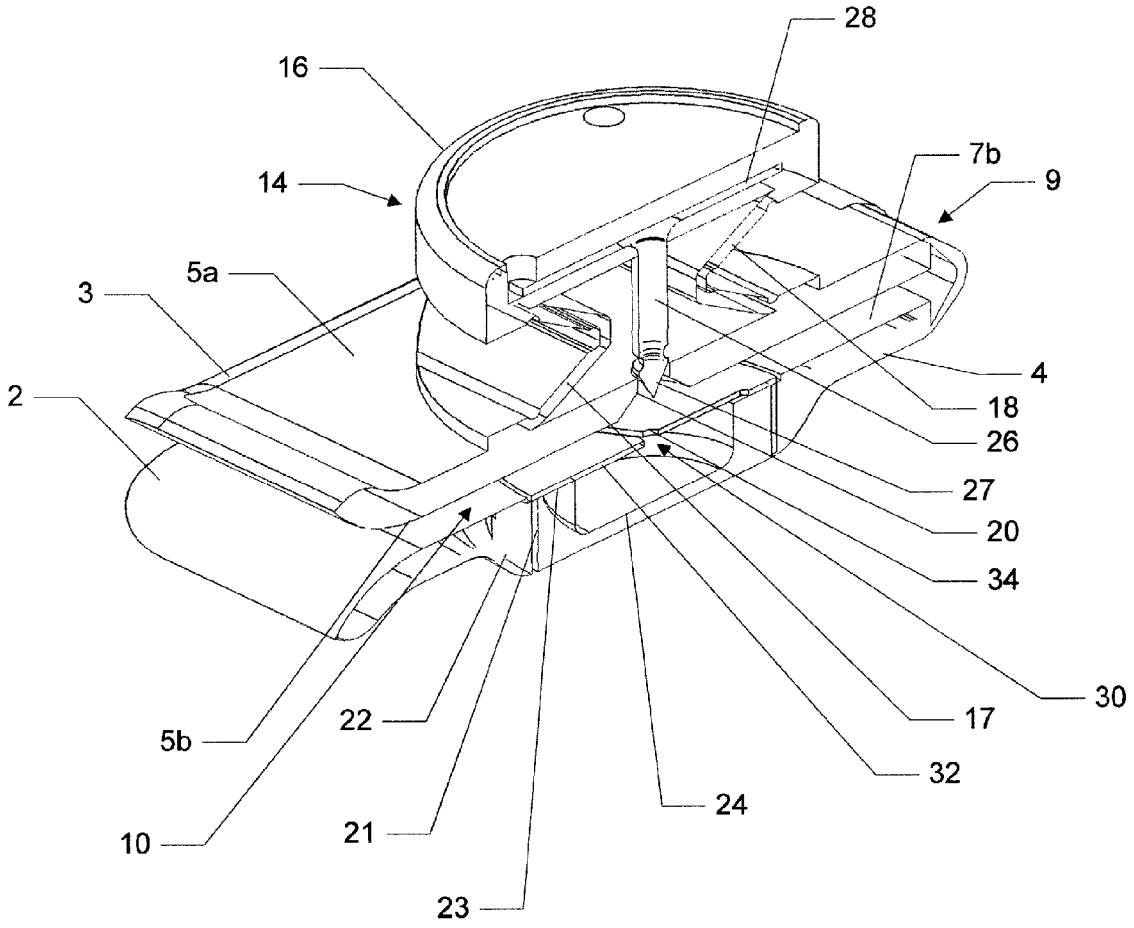
FIG. 6 is a cross-sectional view of the fastener of FIG. 1 taken at section A-A.

Referring to FIG. 6, the body 2 of the fastener 1 is preferably formed as a single unitary body by injection moulding using a plastics material. In this way, the body 2 can be formed around the piercing means 25, such that the button portion 16 of the operating member 14 surrounds the head portion 28 of the pin member 26. The head portion 28 is arranged co-axially with the circular button portion 16 with the pin member 26 projecting toward the first portion 3 of the body 2. The point 27 at the first end of the pin member 26 is received within the hole 20 in the first portion 3. As explained previously, the legs 17, 18 of the operating member 14 serve to bias the button portion 16 away from the first face 5*a* of the first portion 3. Accordingly, the pin member 26 is biased such that the point 27 does not project into the sheet object receiving region 10 between the respective second faces 5*b*, 7*b* of the first and second portions 3, 4 when no external force is applied to the operating member 14. Conveniently, the body 2 of the fastener 1 is formed with the fastener 1 in the open position, and is subsequently folded into the closed position about the hinge arrangement 9 for use.

The retaining means 30 is fixed to the second portion 4 by means of a press-fit. In more detail, the openings 19 in the domed portion 22 communicate with an annular slot 21 which is concentric with and disposed around the recess 24. An annular support surface 23 is therefore defined between the annular slot 21 and the recess 24. The retaining means 30 attaches to the second portion 4 by inserting the locking members 38 into the annular slot 21 such that they align with and are received within respective ones of the openings 19. Each locking member 38 engages with the edges of one of the respective openings 19 so as to hold the retaining means 30 in place. The disc 32 is supported around its periphery by the annular support surface 23 such that, when installed in the body 2, the surface of the disc 32 of the retaining means 30 is flush with second face 7*b* of the second portion 4. This facilitates the insertion of one or more sheet objects into the sheet object receiving region 10 in use.

Figure 7:
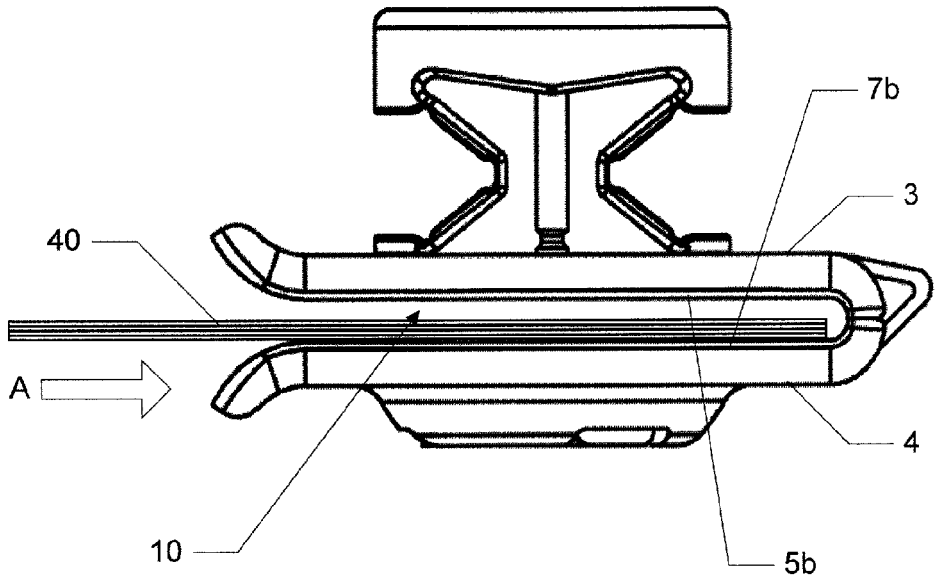
FIG. 7 is a side plan view of the fastener of FIG. 1 with a stack of sheets to be fastened disposed in a sheet object receiving region thereof.

Operation of the fastener 1 will now be described with additional reference to FIGS. 7 and 8. With the fastener 1 in the closed position, the sheet object receiving region 10 is defined between the respective second faces 5*b*, 7*b* of the first and second portions 3, 4. A plurality of sheet objects to be fastened together, such as a stack of papers 40, are inserted into the sheet object receiving region 10 in the direction of arrow 'A' in FIG. 7.

Figure 8:
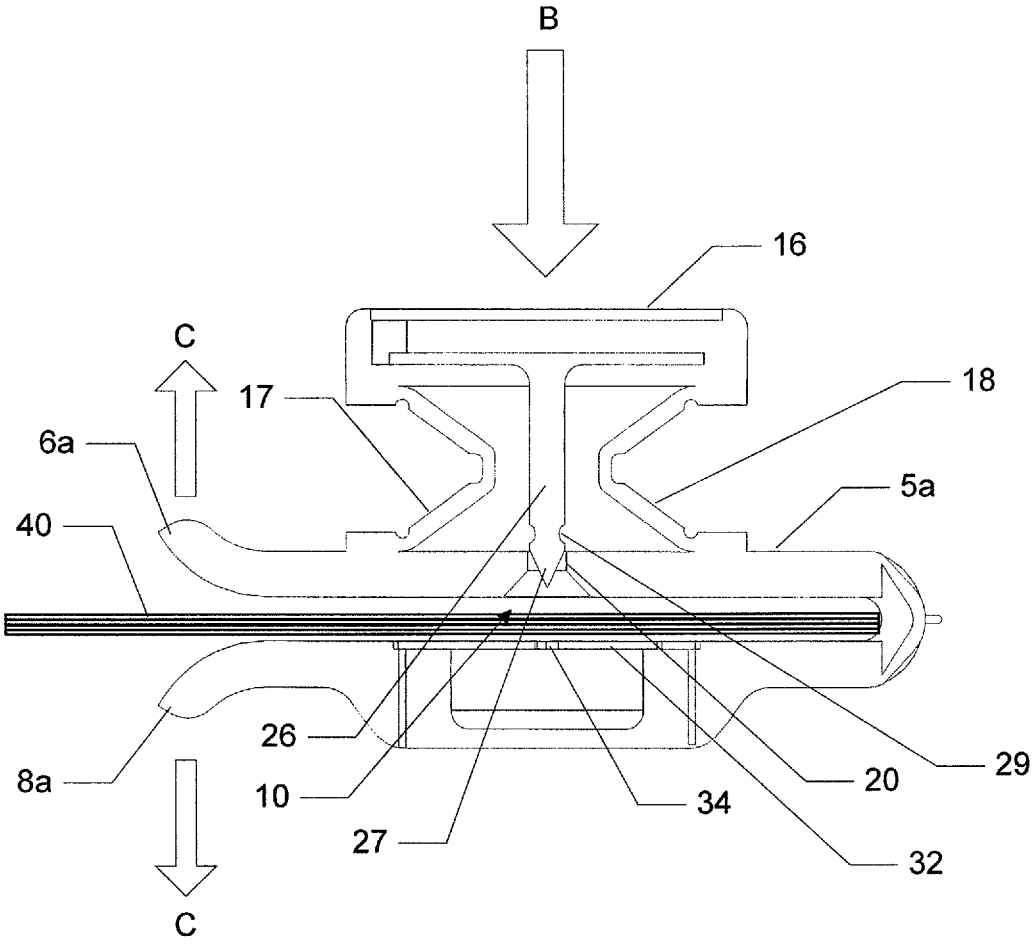
FIG. 8 is a side view of the cross-sectional view of the fastener shown in FIG. 6.

Once the papers 40 are in the desired position, they can be fastened together by a user pressing down on the button portion 16 of the operating member 14, i.e. in the direction of the arrow 'B' in FIG. 8. Downward pressure exerted on the button portion 16 overcomes the biasing force exerted by the legs 17, 18 and causes the button portion 16 to move toward the first face 5*a* of the first portion 3. When this happens, the pin member 26 projects through the hole 20 and traverses the sheet object receiving region 10. When the pin member 26 comes into contact with the papers 40, the sharpened point 27 pierces the papers and passes through them and, subsequently, comes into contact with the retaining means 30. As explained previously, when the fastener 1 is in the closed position, the pin member 26 is co-axial with the aperture 34 in the centre of the disc-shaped pin receiving member 32. The diameter of the pin member 26 is slightly greater than that of the aperture 34, however, the radial slots 36 (not shown in FIGS. 7 and 8) enable the portions 35 of the disc 32 between each slot 36 to flex in a direction perpendicular to the plane of the disc 32 when the pin member 26 presses against them thereby allowing passage of the pin member 26 through the aperture 34. The pin member 26 passes through the aperture 34 until the annular groove 29 comes into alignment with it. At this point, the portions 35 of the disc 32 between the radial slots 36 are permitted to spring back into their initial positions and are thus received within the annular groove 29. Accordingly, by virtue of the engagement of the pin receiving member 32 with the annular groove 29 of the pin member 26, the pin member 26 is fixed in place relative to the pin receiving member 32 thereby fastening together the papers 40 in sheet object receiving region 10. The length of the pin member 26 is selected such that, whilst it is long enough such that the annular groove 29 can engage with the pin receiving member 32, it is not so long that the point 27 contacts the surface of the domed portion 22 before the button portion 16 has reached the maximum extent of its travel. Thus, a user's hand, a part of which will typically rest against the domed portion 22 during application of the fastener 1 to a stack of papers 40, is protected from the pin member 26.

Removal of the fastener 1 from a stack of papers 40 can be effected by simply prising apart the first and second portions 3, 4, for example, by applying opposed forces to the respective ends of the first and second portions 3, 4 furthest from the hinge arrangement 9, i.e. adjacent to the respective first edges 6*a*, 8*a*, as shown by the arrows 'C' in FIG. 8. This provides the user with a mechanical advantage because the opening forces applied to the fastener 1 are spaced apart from the point at which the pin member 26 is engaged with the pin receiving member 32. Additionally, the curved shape of the respective first edges 6*a*, 8*a* of the first and second portions 3, 4 facilitates the removal of the fastener 1 from the stack of papers 40. In particular, each first edge 6*a*, 8*a* curves away from the respective adjacent surface of the stack of papers 40 making it easier for a user to take hold of the fastener 1 and apply and opening force thereto.

A fastener having the above described configuration has a number of advantages compared to known fasteners. As explained above, the fastener 1 includes first and second portions 3, 4 which define a sheet object receiving region therebetween. Piercing means 25 in the form of a pin member 26 is coupled to an operating member 14 which is movably mounted on the first portion 3. The operating member 14 is movable from an initial state, in which the pin member 26 does not project into the sheet object receiving region 10, to an operative state, in which the pin member 26 extends across the sheet object receiving region 10. Retaining means 30 for retaining the piercing means 25 in the operative state are provided in the form of a pin receiving member disposed on the second portion 4.

With this arrangement, a fastener is provided which can securely fasten together a plurality of sheet objects, such as sheets of paper, by piercing the sheets to be fastened. Accordingly, the fastener is resistant to being dislodged from the papers, for example, when a user is reading the contents of the papers or such as when the fastener is otherwise subjected to a sliding force. Furthermore, secure fastening is achieved without the need for a separate applicator device. Rather, the above-described fastener can be applied easily by the simple application of pressure to the operating member. Moreover, the fastener can be removed from a stack of papers without the need for a separate removal device and without the risk of injury to a user's hands.

It will be appreciated by the person skilled in the art that various modifications can be made to the fastener described above with reference to FIGS. 1 to 8 which fall within the scope of the appended claims. For example, fasteners may be provided in different sizes for fastening together different numbers of sheet objects. In this case, the different fasteners may have sheet object receiving regions 10 of different sizes so as to accommodate different numbers and/or thicknesses of sheet objects. Furthermore, pin members 26 of differently sized fasteners may be provided for differently sized fasteners, i.e. fasteners for greater numbers of sheet objects may be provided with more robust pin members 26 having a larger diameter, together with a pin receiving member 32 having a correspondingly sized aperture 34.

It will be appreciated by the skilled person that fasteners having different configurations of piercing means and corresponding retaining means may be provided. For example, the piercing means may comprise two or more pins and the retaining means may comprise a corresponding number of apertures 34. Alternatively, the piercing means 25 may be formed as a blade or as a hollow cylinder having a sharpened edge. In this case, the retaining means may not be disposed on the second portion 4. Instead, the retaining means may be provided on one of the button portion 16 or the first face 5*a* of the first portion 3, and function so as to fix the button portion 16 to the first face 5*a* of the first portion 3 when it has been pressed with the result that the piercing means is retained in the operative state, i.e. such that it extends across the sheet object receiving region 10.

Figure 3B:
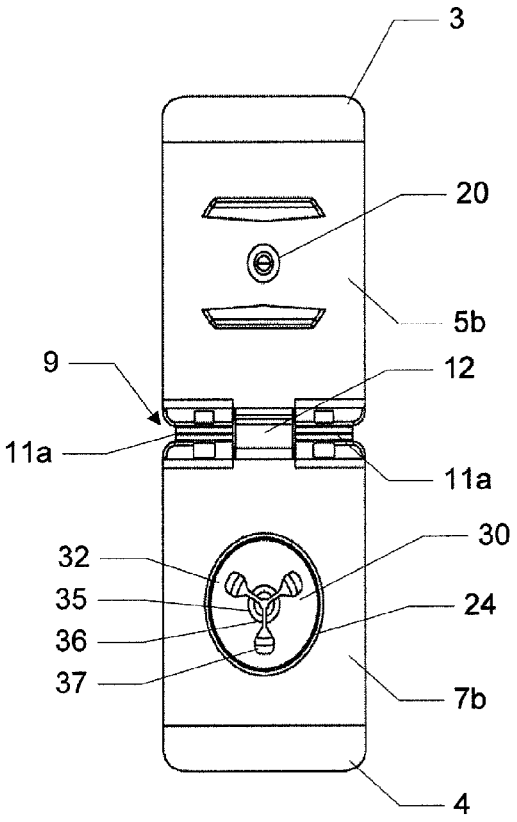

In the embodiment shown in FIG. 5, the radial slots 36 of the pin receiving member 32 are linear. Referring again to FIG. 3*b*, in an alternative embodiment the radial slots 36 of the pin receiving member 32 may terminate with a region 37 in which the width of the slot 36 increases. With this arrangement, the portions 35 of the pin receiving member 32 between the radial slots 36 have a reduced surface area compared to the FIG. 5 embodiment in which the radial slots 36 are linear. The Applicant has found that a pin receiving member 32 having radial slots 36 of the kind shown in FIG. 3*b* provides a particularly secure engagement with the annular groove of the pin member 26.

In an alternative embodiment, the pin member 26 does not have an annular groove 29. In this case, the pin member 26 is retained within the pin receiving member 32 solely by the force of the portions 35 between the radial slots 36 pressing against pin member 26, when the pin member 26 has been pushed into the aperture 34.

The invention claimed is:

1. A fastener for sheet objects comprising:

first and second portions which are positioned or are positionable in an adjacent spaced relationship with respect to each other so as to define a sheet object receiving region therebetween;

piercing means mounted on the first portion, the piercing means being adapted so as to pierce one or more sheet objects disposed within the sheet object receiving region when moved into an operative state in which the piercing means extends across the sheet object receiving region between the first and second portions; and retaining means for retaining the piercing means in the operative state when moved thereto, wherein the piercing means comprises a pin member with a pointed end, the pin member is mounted on the first portion so as to be movable with respect thereto, the pin member is coupled to an operating member having a button portion adapted for manipulation by a user, the operating member includes two legs adapted to fold and a biasing means for biasing the operating member towards an initial state in which the piercing means does not extend across the sheet object receiving region, and the retaining means includes a pin-receiving member disposed on the second portion, the pin-receiving member having an aperture for receiving the pin member therein, the aperture being disposed in a centre of a disc forming part of the pin-receiving member, the pin-receiving member comprising a plurality of linear radial slots extending from the aperture towards a circumference of the disc.

2. The fastener according to claim 1, wherein the piercing means is biased toward an initial state in which it does not extend across the sheet object receiving region.

3. The fastener according to claim 1, wherein the piercing means is coupled to an operating member adapted for manipulation by a user.

4. The fastener according to claim 3, wherein the operating member comprises a button portion.

5. The fastener according to claim 1, wherein the pin member comprises an annular groove for engagement with the retaining means when the piercing means are in the operative state.

6. The fastener according to claim 1, wherein the pin member is arranged so as to project through a hole in the first portion when it is moved toward the operative state.

7. The fastener according to claim 1, wherein said at least one radial slot comprises a linear portion adjacent to the aperture and terminates in a portion having an increased width relative to the linear portion.

8. The fastener according to claim 1, wherein the pin receiving member comprises three radial slots spaced equiangularly around the aperture.

9. The fastener according to claim 1, wherein the pin receiving member is provided with at least one locking member for engagement with a corresponding opening provided in the second portion so as to couple the pin receiving member thereto.

10. The fastener according to claim 1, wherein the piercing means is received within a recess formed in the second portion when in the operative state.

11. The fastener according to claim 1, wherein the sheet object receiving region is defined between respective substantially planar faces of the first and second portions.

12. The fastener according to claim 11, wherein the respective planar faces diverge so as to define an entry region of the sheet object receiving region in order to facilitate the insertion of one or more sheet objects thereinto.

13. The fastener according to claim 1, wherein the first and second portions are coupled by a hinge.

14. The fastener according to claim 13, wherein the first and second portions are pivotable about the hinge between a closed position in which the sheet object receiving region is defined between respective substantially planar faces of the first and second portions and an open position in which the first and second portions are pivoted about the hinge away from the closed position.

15. The fastener according to claim 14, wherein the hinge is spring biased so as to urge the fastener toward the closed position or the open position in dependence on the angular position of the first and second portions about the hinge.

16. The fastener according to claim 15, wherein the hinge is biased by a spring arm.

17. The fastener according to claim 13, wherein the hinge comprises at least one flexible linkage between the first portion and the second portion.

18. The fastener according to claim 1, wherein the first and second portions are formed as a unitary body.

19. The fastener according to claim 18, wherein the body is made from a plastics material.

20. The fastener according to claim 19, wherein the body is made using an injection moulding process.

* * * * *